US005790002A

United States Patent [19]

Fischer et al.

[11] Patent Number: 5,790,002

[45] Date of Patent: Aug. 4, 1998

[54] TWO PART SPACER FOR A HIGH-FREQUENCY COAXIAL CABLE HAVING A PROTRUSION ON ONE OF THE PARTS

[75] Inventors: Horst Fischer; Hartmut Gohdes, both of Hanover, Germany

[73] Assignee: Alcatel Alsthom Compagnie Generale d'Electricite, France

[21] Appl. No.: 791,414

[22] Filed: Jan. 24, 1997

[30] Foreign Application Priority Data

Jan. 26, 1996 [DE] Germany ..... 196 02 755.1

[51] Int. Cl.[6] ..... H01P 1/00; H01P 3/06

[52] U.S. Cl. ..... 333/244; 174/174

[58] Field of Search ..... 333/243, 244; 174/28, 29, 167, 168, 172, 174, 175; 29/600

[56] References Cited

U.S. PATENT DOCUMENTS 3,271,506 9/1966 Martin et al. ..... 333/244 X 4,145,565 3/1979 Donon ..... 174/28

FOREIGN PATENT DOCUMENTS 1 515 832 9/1972 Germany .

1 640 711 8/1973 Germany .

*Primary Examiner*—Paul Gensler

*Attorney, Agent, or Firm*—Ware, Fressola, Van der Sluys & Adolphson LLP

[57] ABSTRACT

A spacer is indicated for a high-frequency coaxial cable with an inner conductor, a tube-shaped outer conductor and a dielectric cavity located between the two conductors, which has a higher thermal load-carrying capacity in the inner conductor area than in the outer conductor area, due to the use of different materials. The parts of the spacer which are made of different materials are radially superimposed and are solidly interlocked with each other by means of injection molding.

9 Claims, 1 Drawing Sheet

TWO PART SPACER FOR A HIGH-FREQUENCY COAXIAL CABLE HAVING A PROTRUSION ON ONE OF THE PARTS

BACKGROUND OF THE INVENTION

1. Technical Field

The invention refers to a spacer for a high-frequency coaxial cable with an inner conductor, a tube-shaped outer conductor and a dielectric cavity located between the two conductors, which has a higher thermal load-carrying capacity in the inner conductor area than in the outer conductor area due to the use of different materials.

2. Description of the Prior Art

High-frequency coaxial cables (HF cables) of different sizes are used mainly as antenna conductors to transport HF energy between an antenna and a transmitter-receiver station. A dielectric with a low dielectric constant and low dielectric loss is needed between the two conductors to obtain as low a loss of HF energy as possible. This can be achieved with a dielectric cavity by selecting a suitable insulation material for the spacer. Polyethylene is an example of such an insulation material. The spacer can be in the form of disks or individual supports which are attached to the inner conductor at radial distances from each other, and serve to support the outer conductor. In a preferred configuration, a strand of insulation material which is helically wound around the inner conductor is used as the spacer.

The HF cable is heated by the transmission of HF energy. The highest temperature occurs at the inner conductor. The spacer must be configured so that it retains its shape when the inner conductor reaches its maximum temperature. For example, DE-C-1 640 711 describes a spacer that withstands high temperatures. In this case, three individual supports made of a hard-elastic material are held together by a spring-steel bow. This spacer was proven in practice. However, it is altogether expensive.

DE-C-1 515 832 describes a spacer in which the spoke-shaped spacers are made of different materials. The part resting against the inner conductor consists exclusively of a radially outward protruding crosspiece made of polyvinylcarbazole which, although it is a brittle material, has a high thermal load-carrying capacity. The ends of the crosspieces resting against the outer conductor are made of flexible insulation material. They are shaped like expanded rockers. The publication does not specify how the two different materials are interconnected. Furthermore, this spacer is expensive as well.

SUMMARY OF INVENTION

It is an object of the present invention to configure a spacer so that it is simple to construct and has a high thermal load-carrying capacity.

The object is fulfilled according to the invention in that the parts made of the different materials and which are radially superimposed, are solidly interlocked with each other by means of injection molding.

When the proper material is used, this spacer has a high thermal load-carrying capacity, it is simple to construct and is cost-effective. A high-temperature resistant material is used for the part of the spacer which rests against the inner conductor. Such materials are for example polytetrafluorethylene (PTFE) or fluoridated ethylene-propylene (FEP). This part of the spacer is kept as small as possible in the radial direction. Lower priced materials with high dielectric properties may be used for the part of the spacer positioned radially outward of the part of the spacer which lies against the inner conductor. The elements of the spacer are produced with the usual technology. The two different materials are bonded to each other by means of injection (extrusion) molding. It is useful to mold a protrusion on one of the parts which is surrounded by the material of the other part. The elements of the spacer produced in this manner can be processed with the usual technology. Even though the farther outside lying material does not have such a high thermal load-carrying capacity, the result is a cost-effective, high grade dielectric spacer with a high thermal load-carrying capacity.

The invention will be fully understood when reference is made to the following detailed description taken in conjunction with the accompanying drawing.

DETAILED DESCRIPTION OF THE INVENTION

Figure 1:
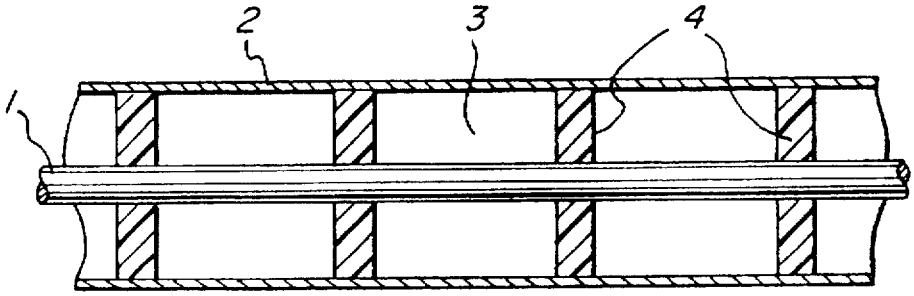
FIGS. 1 and 2 are longitudinal cross sectional views of two different HF cables.
Figure 2:
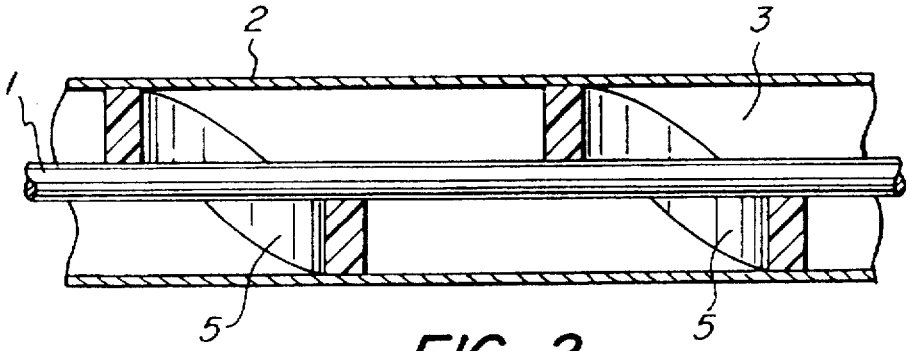

FIGS. 1 and 2 schematically illustrate an HF cable with an insulated cavity. It comprises an inner conductor 1 and a tube-shaped outer conductor 2, between which the dielectric cavity 3 is located. Both conductors 1 and 2 are preferably made of copper.

The dielectric cavity 3 contains a spacer which coaxially links the inner conductor 1 and the outer conductor 2 to each other. According to FIG. 1, the spacer comprises disks 4 arranged on the inner conductor 1 at an axial distance from each other. The outer conductor 2 rests on the outside of the disks 4. According to FIG. 2, a strand 5 which is helically wound around the inner conductor is used as the spacer. The outer conductor 2 rests on the outside of the strand 5. Individual supports attached to the inner conductor 1 can also be used as the spacer instead of the disks 4 and the strand 5.

Figure 3:
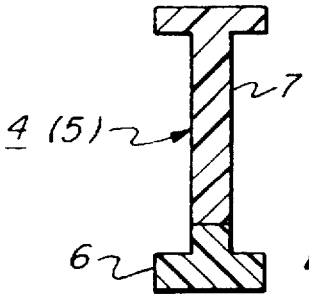
FIG. 3 is a cross sectional view of an element of a spacer according to the invention.

FIG. 3 illustrates a cross-section through a disk 4 or a strand 5 of the spacer. It therefore comprises two parts 6 and 7, which are interlocked by injection molding. Part 6 is designed to be applied to the inner conductor 1 of an HF cable. It is made of an insulation material with a high thermal load-carrying capacity, such as polytetrafluorethylene or fluoridated ethylene-propylene. Its radial dimensions are kept as small as possible and result from the expected temperature range between the inner and the outer conductor at maximum input power to the HF cable. Part 7 is made of a high grade dielectric insulation material, whose thermal load-carrying capacity is lower. For example, polyethylene can be used for the part 7.

Figure 4:
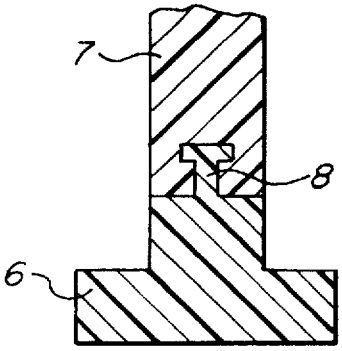
FIG. 4 is an enlarged detail of the element in FIG. 3.

The two parts 6 and 7 of the spacer can be solidly interlocked by means of injection molding in a tool, so that a disk 4 or with continuous production a strand 5 can be manufactured. A protrusion 8 which is surrounded by the material of part 7 can also be molded to additionally anchor the two parts 6 and 7 to each other. The protrusion 8 can have a T-shaped cross section, as illustrated in FIG. 4. This additional anchor is useful if the two different materials do not sufficiently bond with each other during the injection molding process. The protrusion 8 could also be formed on part 7. In that case, it would be surrounded by the material of part 6.

A two-stage method could be used particularly to produce the strand 5, whereby part 6 with a protrusion 8 is injection molded first, and part 7 is molded in a second tool, or vice versa.

The described construction of disks 4 and strand 5 applies also analogically if these elements of the spacer are, or will be, constructed of more than two radially superimposed parts.

In producing a cable with a spacer in accordance with the present invention, the spacer produced prior to producing the cable is applied to the inner conductor 1 which moves in a lengthwise direction. The outer conductor 2 is formed around the spacer.

The preferred embodiments described above admirably achieve the objects of the invention. However, it will be appreciated that departures can be made by those skilled in the art without departing from the spirit and scope of the invention which is limited only by the following claims.

What is claimed is:

1. A spacer for a high-frequency coaxial cable with an inner conductor, a tube-shaped outer conductor and a dielectric cavity located between the inner and outer conductors, which comprises a first part adjacent the inner conductor and a second part spaced from the inner conductor, the parts are made of different materials so that the first part has a higher thermal load-carrying capacity than the second part, the parts are superimposed in a radial direction and solidly interlocked with each other by a protrusion located on one of the parts, which is surrounded by injection molded material of the other part.

2. A spacer as claimed in claim 1 having a disk-like shape.

3. A spacer as claimed in claim 1 having a shape of a strand which can be helically wrapped around the inner conductor.

4. A high-frequency coaxial cable comprising:

(a) an inner conductor;

(b) a spacer on the inner conductor, the spacer having a first part adjacent the inner conductor and second part spaced from the inner conductor, the parts are made of different materials so that the first part has a higher thermal load-carrying capacity than the second part, the parts are superimposed in a radial direction and solidly interlocked with each other by a protrusion located on one of the parts, which is surrounded by injection molded material of the other part; and (c) a tube-shaped outer conductor surrounding the inner conductor and spacer to create a dielectric cavity located between the inner and outer conductors.

5. A high-frequency coaxial cable as claimed in claim 4, wherein the spacer is at least one disk.

6. A high-frequency coaxial cable as claimed in claim 4, wherein the spacer is a strand helically wrapped around the inner conductor.

7. A method of producing a high-frequency coaxial cable, comprising the steps of:

(d) providing an inner conductor;

(e) applying a spacer to the inner conductor, the spacer having a first part adjacent the inner conductor and a second part spaced from the inner conductor, the parts are made of different materials so that the first part has a higher thermal load-carrying capacity than the second part, the parts are superimposed in the radial direction and solidly interlocked with each other by forming a protrusion on one of the parts and injection molding material of the other part around said protrusion; and (f) forming a tube-shaped outer conductor around the inner conductor and the spacer to form a dielectric cavity located between the inner and outer conductors.

8. A method as claimed in claim 7, wherein the spacer is at least one disk.

9. A method as claimed in claim 7, wherein the spacer is a strand helically wrapped around the inner conductor during the applying step.

* * * * *